US010744381B2

(12) United States Patent
Malina et al.

(10) Patent No.: US 10,744,381 B2
(45) Date of Patent: Aug. 18, 2020

(54) GOLF BAG COVER

(71) Applicants: Russell Malina, Golden Beach, FL (US); Daniel Alvarez, Golden Beach, FL (US)

(72) Inventors: Russell Malina, Golden Beach, FL (US); Daniel Alvarez, Golden Beach, FL (US)

(73) Assignee: FLOGCAP LLC, Golden Beach, FL (US)

( * ) Notice: Subject to any disclaimer, the term of this patent is extended or adjusted under 35 U.S.C. 154(b) by 0 days.

(21) Appl. No.: 16/410,305

(22) Filed: May 13, 2019

(65) Prior Publication Data

US 2019/0374826 A1 Dec. 12, 2019

Related U.S. Application Data

(60) Provisional application No. 62/681,329, filed on Jun. 6, 2018.

(51) Int. Cl.
*A63B 55/60* (2015.01)
*A63B 55/00* (2015.01)

(52) U.S. Cl.
CPC ..... *A63B 55/406* (2015.10); *A63B 55/60* (2015.10); *A63B 55/61* (2015.10); *A63B 2209/10* (2013.01); *A63B 2210/50* (2013.01)

(58) Field of Classification Search
CPC ..... A63B 55/406; A63B 55/60
USPC ..... 206/315.4, 315.5; 150/159
See application file for complete search history.

(56) References Cited

U.S. PATENT DOCUMENTS

| | | | | | |
|---|---|---|---|---|---|
| 2,718,251 | A * | 9/1955 | Barbato | A63B 55/406 | 150/159 |
| 2,907,364 | A * | 10/1959 | Trenery | A63B 55/406 | 150/159 |
| 4,200,133 | A * | 4/1980 | Whitlow | A63B 55/406 | 150/159 |
| 4,953,768 | A * | 9/1990 | Muse | A63B 55/406 | 224/613 |
| 5,507,332 | A * | 4/1996 | McKinnon | A63B 55/408 | 150/159 |
| 5,718,333 | A * | 2/1998 | Armour | A63B 55/404 | 150/159 |
| 5,797,439 | A * | 8/1998 | Brandriet | A63B 55/406 | 150/159 |
| 5,860,519 | A * | 1/1999 | Meyer | A63B 55/00 | 206/315.3 |
| 5,904,247 | A * | 5/1999 | Voelkner, Jr. | A45C 13/20 | 150/159 |
| 6,478,151 | B1 * | 11/2002 | Schmidt | A45C 7/0086 | 190/108 |
| 6,883,566 | B2 * | 4/2005 | Dirnberger | A63B 55/404 | 150/159 |
| 2010/0252465 | A1 * | 10/2010 | Pryor | A63B 55/57 | 206/315.4 |

* cited by examiner

*Primary Examiner* — Sue A Weaver
(74) *Attorney, Agent, or Firm* — Patterson Thuente Pedersen, P.A.

(57) ABSTRACT

Disclosed herein is a golf bag cover for use in covering a golf bag having golf clubs placed therein. The golf bag cover is configured to couple to the bottom portion of a golf bag in a closed position and can selectively cover the golf bag and golf clubs in an open position. In the closed position, the golf bag cover can collapse into an integrated pouch and remain attached to the base of the golf bag.

20 Claims, 6 Drawing Sheets

GOLF BAG COVER

CROSS-REFERENCE TO RELATED APPLICATION

The present application claims priority to U.S. Application No. 62/681,329, filed on Jun. 6, 2018, which are hereby fully incorporated herein by reference.

TECHNICAL FIELD

The present disclosure relates to golf bag accessories, and in particular, to covers for golf bags.

BACKGROUND

Conventionally, the game of golf is played outdoors and can last for many hours. Because the game of golf is played outdoors and for a long period of time, precipitation such as rain can occur during play. In the event of rain or other precipitation, the golfer, the golfer's golf bag, and any other golf equipment may and likely will get wet. Generally, getting the golf bag, and especially the golf clubs, wet is undesirable.

Golf bag travel bags are a popular golf bag accessory for golfers. Golf bag travel bags, however, are designed to fully encapsulate the golf bag and golf clubs to protect them during travel. Because golf clubs and various portions of the golf bag need to be readily accessible during play, golf bag travel bags are an undesirable accessory when the golfer is on the course. Further, a golfer often uses a pull cart or a golf cart to carry their golf bag and other golf equipment. In these circumstances the golf bag is coupled directly to the pull cart or golf cart making a golf bag travel bag unusable as it would interfere with the golf bag being secured to the pull cart or golf cart.

Golf club covers are designed to protect the golf clubs during play. Club covers are conventionally configured to couple to a top portion of the bag and cover golf club heads. Club covers, however, do not protect the entire golf bag or even the entire club. It is undesirable for the golf bag to get wet because golf bags conventionally have various equipment coupled to the exterior of the bag, e.g., gloves, towel, etc., and multiple exterior pockets which are configured to hold personal items and golf equipment. Golf bags also include openings into which the clubs are inserted and precipitation can enter these openings to make the clubs shafts and handles wet even if the club heads are covered with a club cover. Thus, club covers are insufficient with respect to full protection against precipitation.

SUMMARY

Disclosed herein is a golf bag cover for use in covering a golf bag having golf clubs placed therein. The golf bag cover is configured to couple to the bottom portion of a golf bag in a closed position and can selectively cover the golf bag and golf clubs in an open position. In the closed position, the golf bag cover can collapse into an integrated pouch and remain attached to the base of the golf bag. Unlike other devices, the golf bag cover does not require the entire golf bag to be placed inside the cover and simply unfurls from the bottom and secures over the top with elastic. By unfastening the cover that is secured at the bottom of the bag, golfers can quickly and easily keep golf bags and clubs dry in the event of precipitation. The system is fast, requiring no lifting of the bag or dismounting of the bag from the golf cart and also packs down very small, securing tightly to the bottom of the bag while providing more coverage to the club, bag and its contents.

In embodiments, the golf bag cover can include a body includes an edge and a bottom portion. The body can define a cavity sized and shaped to encapsulate the golf bag having golf clubs placed therein in an open position. The golf bag cover can also include an elastic edge coupled to the edge of the body. The golf bag further includes a pouch portion coupled to the bottom portion of the body. The pouch portion is configured to house the body when the body is in a collapsed position. The golf bag cover also includes a bag coupling attached to the pouch portion. The bag coupling is configured to attach to the bottom portion of the golf bag. When the bag coupling is attached to the bottom portion of the golf bag, the body can be extended from the bottom portion of the golf bag to the open position to encapsulate a substantial portion of the golf clubs and the golf bag.

Further herein is a method of making a golf bag cover for use in covering a golf bag having golf clubs placed therein. The method includes coupling an elastic edge to an outside edge of a body, wherein the body includes an outside edge and a bottom portion. The body can be sized and shaped to encapsulate the golf bag. The method also includes coupling a pouch portion to the bottom portion of the body. The pouch portion can be configured to house the body when the body is in a collapsed position. In some embodiments, the pouch portion may be monolithically formed with the body and therefore not separately coupled to the body. The method also includes coupling a bag coupling to the pouch portion, the bag coupling configured to be coupleable to a bottom portion of the golf bag such that when the body is in an open position, the body encapsulates a substantial portion of the golf clubs and the golf bag.

Further herein is a golf bag cover system including a golf bag having a bottom portion and configured to have golf clubs placed therein. The golf bag cover system also includes a golf bag cover that can be coupleable to the bottom portion of the golf bag. The golf bag cover can include a body includes an edge and a bottom portion. The body can define a cavity sized and shaped to encapsulate the golf bag and golf clubs in an open position. The golf bag cover can also include an elastic edge coupled to the edge of the body. The golf bag further includes a pouch portion coupled to the bottom portion of the body. The pouch portion is configured to house the body when the body is in a collapsed position. The golf bag cover also includes a bag coupling attached to the pouch portion. The bag coupling is configured to attach to the bottom portion of the golf bag. When the bag coupling is attached to the bottom portion of the golf bag, the body can be extended from the bottom portion of the golf bag to the open position to encapsulate a substantial portion of the golf clubs and the golf bag.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1A:
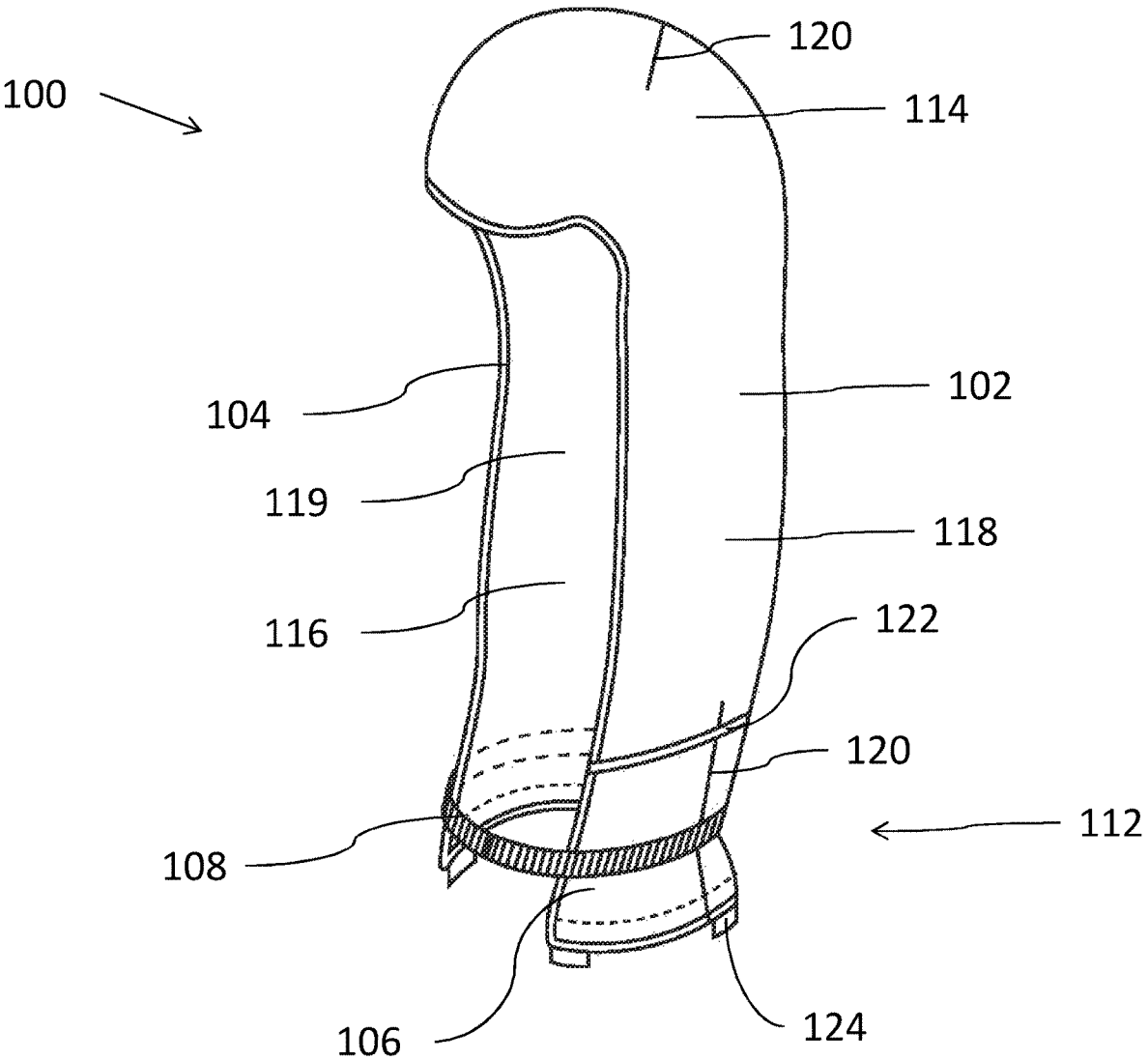
FIG. 1A is an isometric view of a golf bag cover in an open position, according to embodiments disclosed herein.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Disclosed herein is a golf bag cover configured to selectively cover a golf bag and golf clubs. The golf bag cover can be used to cover and uncover a golf bag and golf clubs while the golf bag is secured to a pull cart or golf cart. Additionally or alternatively, the golf bag cover can be used to cover and uncover a golf bag and clubs carried by a user.

Figure 1B:
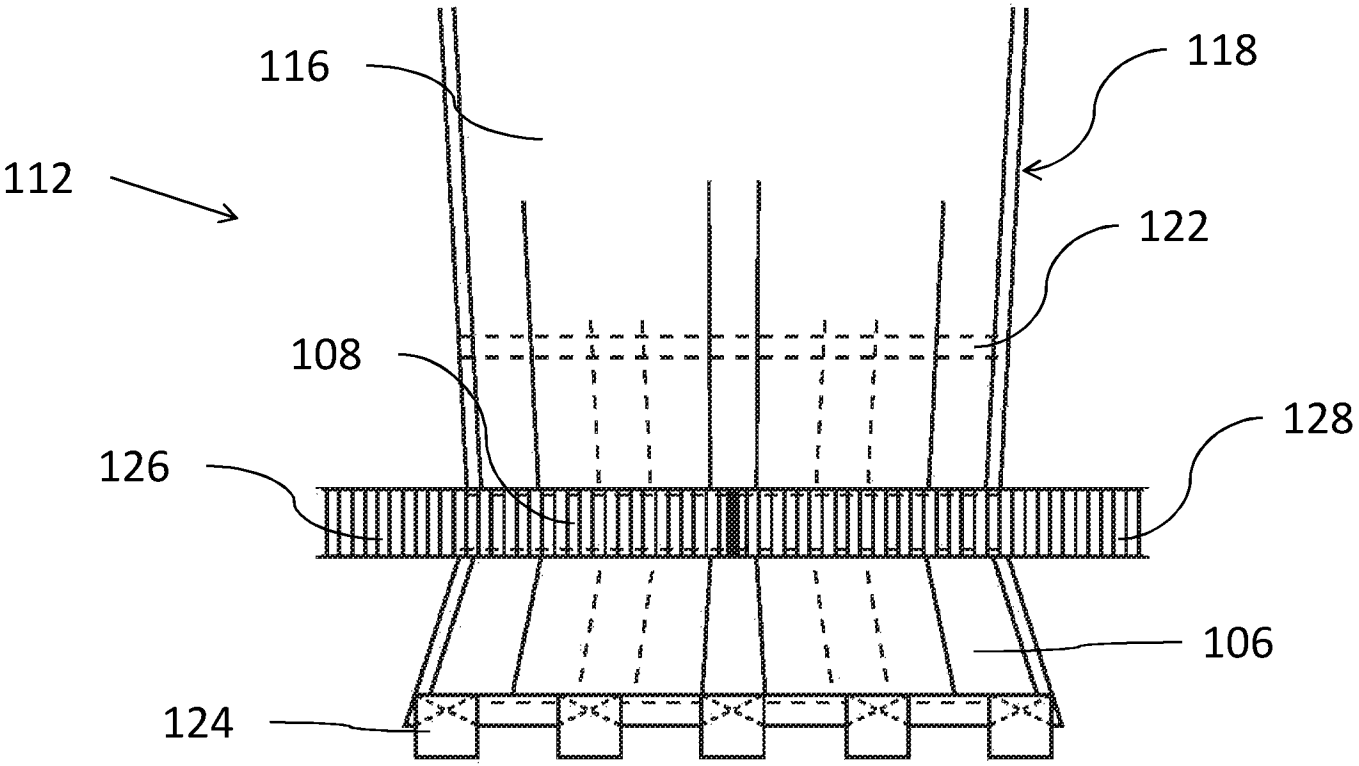
FIG. 1B is partial front view of a bottom portion of a golf bag cover, according to embodiments disclosed herein.

As depicted in FIGS. 1A and 1B, one embodiment of a golf bag cover 100 includes a body 102, an elastic edge 104, a pouch portion 106, and a bag coupling 108. Body 102 can further include a base portion 112, a top portion 114, an interior surface 116, and an exterior surface 118. Bag coupling 108 can be coupled to interior surface 116 or exterior surface 118 at base portion 112. Elastic edge 104 can be coupled to an outer edge of body 102. Elastic edge 104 is configured to provide an elastic closing force such that the edge portion of body 102 is biased to enclose inward toward interior surface 116. Elastic edge 118 and interior surface 116 define a cavity 119. Cavity 119 is configured to substantially cover a golf bag and golf clubs. Body 102 can comprise a waterproof and elastic material such as, for example, polyester spandex. In one embodiment, body 102 can comprise a material having the composition of 88% polyester and 12% spandex. In other embodiments other suitable waterproof and elastic materials are contemplated. In some embodiments, the water proof ability can be enhanced by a film or other surfactant applied to exterior surface 118. Elastic edge 104 can comprise a rubber and polyester composite. For example, elastic edge 104 can comprise an 80% polyester and 20% rubber material. In other embodiments other suitable elastic materials are contemplated.

Body 102 can also include a plurality of seams 120. Seams 120 are configured to provide body 102 with a desired shape and provide additional structure to body 102. Thus, seams 120 shape and reinforce body 102 such that when a golf bag and golf clubs are received in cavity 119, body 102 is closely fitted to the golf bag and golf clubs.

Pouch portion 106 is coupled to base portion 112 of body 102, as depicted in FIG. 1B. In one embodiment, pouch portion 106 is integral with body 102 such that pouch portion 106 and base portion 112 are monolithic. Pouch portion 106 can further include a pouch top coupling 122 and a pouch bottom coupling 124. Pouch bottom coupling 124 can be coupled to a lower edge of pouch portion 106. In one embodiment and as depicted in FIG. 1B, a plurality of pouch separate, individual bottom couplings 124 can be arranged on the lower edge of pouch portion 106. In other embodiments, pouch bottom couplings 124 can comprise one larger coupling. Pouch top coupling 122 can be coupled to exterior surface 118 of body 102 or interior surface 116 of body 102. Pouch top coupling 122 can be arranged on exterior surface 118 such that it is spaced from pouch bottom couplings 124. In one embodiment, pouch top coupling 122 is spaced 12 cm from pouch bottom coupling 124. In other embodiments, pouch top coupling 122 is spaced from pouch bottom coupling 124 ranging from 3 cm to 25 cm.

In embodiments, pouch top coupling 122, pouch bottom coupling 124 can comprise hook and loop type couplings, such as Velcro®. In other embodiments, button snap couplings, strap and buckle type couplings, clip-type couplings, or any other type of suitable coupling can be used.

Figure 2:
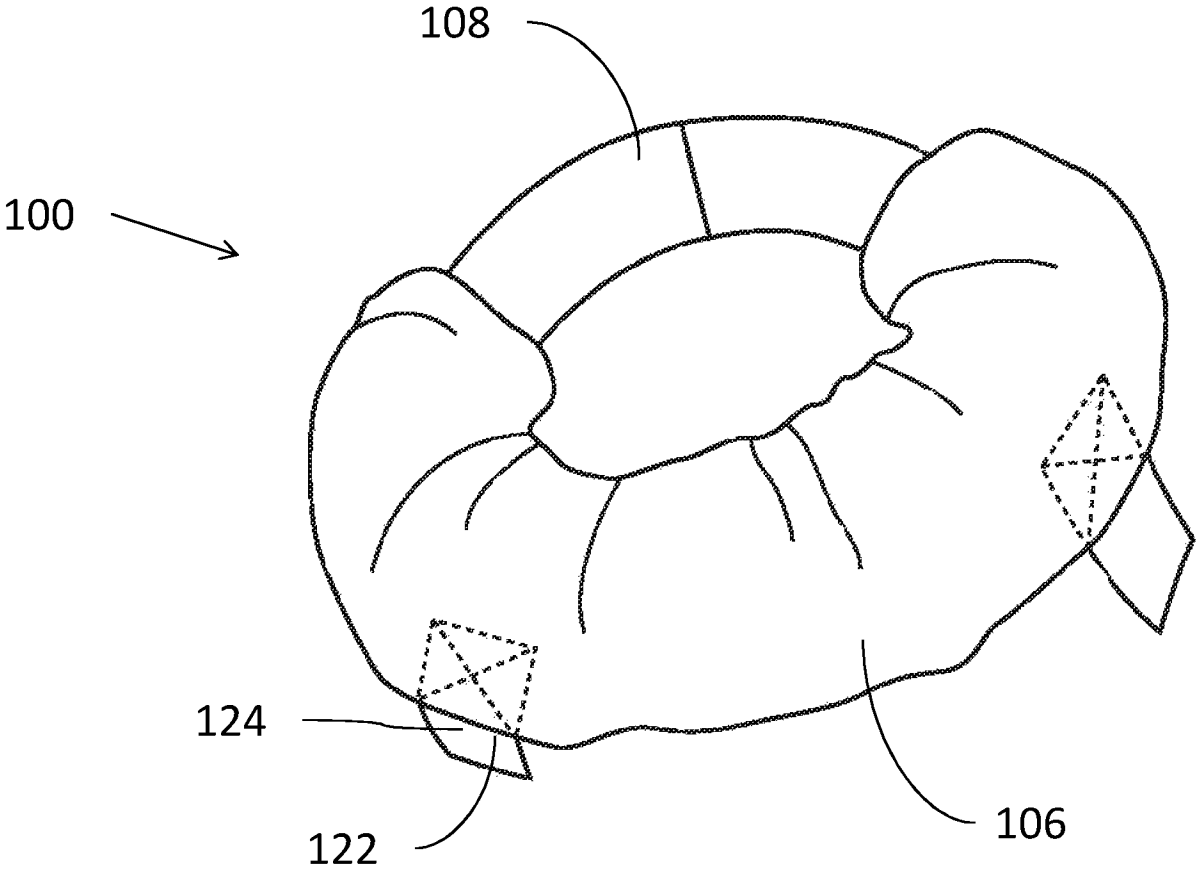
FIG. 2 is an isometric view of a golf bag cover in a closed position, according to embodiments disclosed herein.

Referring now to FIG. 2, pouch top coupling 122 and pouch bottom coupling 124 are configured to couple together such that golf bag cover 100 can be in a closed position. In the closed position, pouch top coupling 122 and pouch bottom coupling 124 couple together to create an enclosure from pouch portion 106. Body 102 is configured to collapse or roll up such that body 102 can be housed within pouch portion 106 when pouch top coupling 122 and pouch bottom coupling 124 are couple together. Further, the spacing of pouch top coupling 122 and pouch bottom coupling 124 can depend on the size of body 102 when body 102 is in the collapsed configuration of the closed position. Bag coupling 108 can include a first portion 126 and a second portion 128. In one embodiment, first portion 126 and second portion 128 are configured to wrap around the golf bag to secure the cover 100 to the golf bag by coupling first portion 126 to second portion 128. Alternatively, bag coupling 108 can be configured with features that attach directly to the golf bag. Further, first portion 126 and second portion 128 can comprise adjustable or elastic straps with integrated or coupled coupling mechanisms attached thereto.

Figures 3A, 3B:
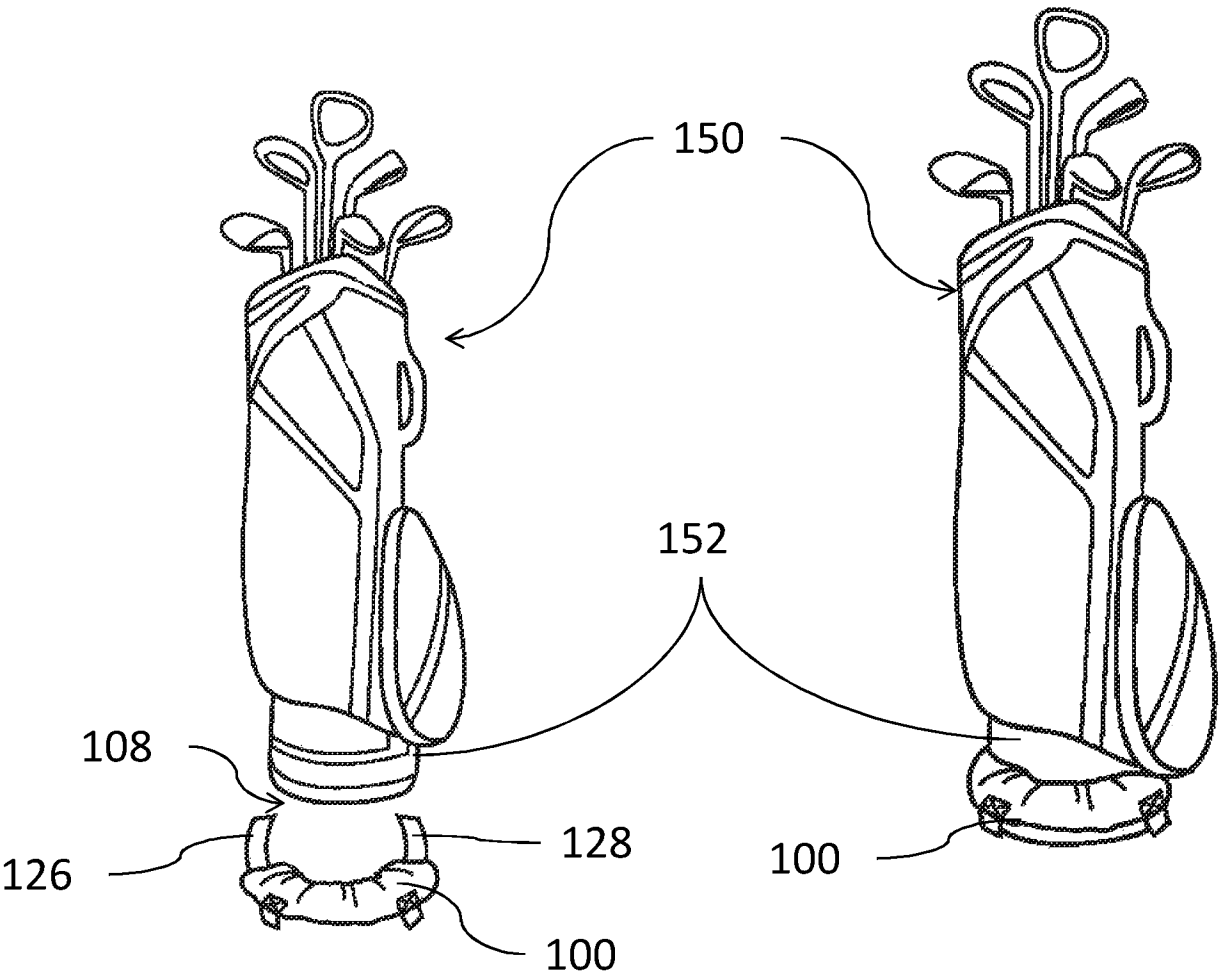
FIGS. 3A-3B are isometric views of a golf bag cover in various stages of installation onto a golf bag, according to embodiments disclosed herein.

In use, and as depicted in FIGS. 3A-3B, golf bag cover 100 can be installed on a golf bag 150 at a base 152 of the golf bag 150 with golf bag cover 100 in the closed position. First portion 126 of bag coupling 108 can be decoupled from second portion 128 of bag coupling 108 as depicted in FIG. 3A. When first portion 126 is decoupled from second portion 128, golf bag cover 100 can be arranged at base 152 as is depicted in FIG. 3B. First portion 126 and second portion 128 can then wrap around base 152. Once first portion 126 and second portion 128 are wrapped around base 152, first portion 126 can be coupled to second portion 128, securing golf bag cover 100 to base 152, depicted in FIG. 3B. In embodiments, golf bag cover 100 can be coupled to golf bag 150 when golf bag 150 is standing alone, or, golf bag cover 100 can be coupled to golf bag 150 when golf bag 150 is coupled to a pull cart or golf cart.

In embodiments, bag coupling 108 can comprise hook and loop type couplings, such as Velcro®. In other embodiments, button snap couplings, strap and buckle type couplings, clip-type couplings, or any other type of suitable coupling can be used. Bag coupling 108 can also be adjustable in length such that bag coupling 108 can couple to a variety of golf bag 150 diameters. Further, a combination of coupling types can be used such that bag coupling 108 comprises one type of coupling mechanism and pouch top coupling 122 and pouch bottom coupling 124 comprises another type of coupling.

Figure 4C:
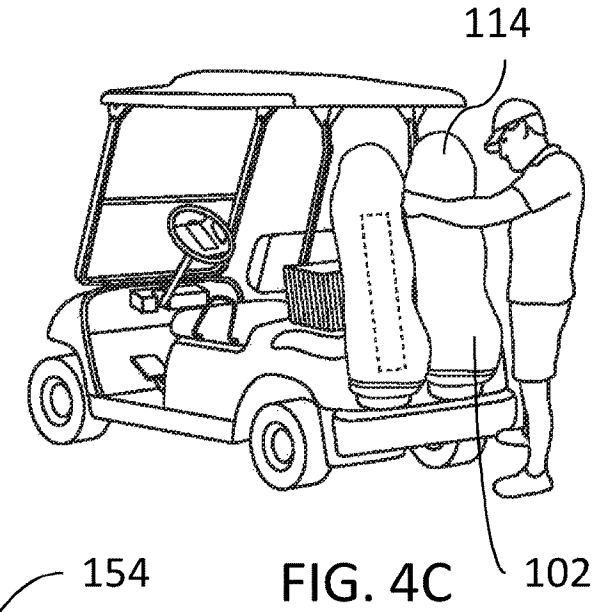
FIGS. 4A-4C are isometric views of a golf bag cover in various stages of covering a golf bag, according to embodiments disclosed herein.
Figure 4B:
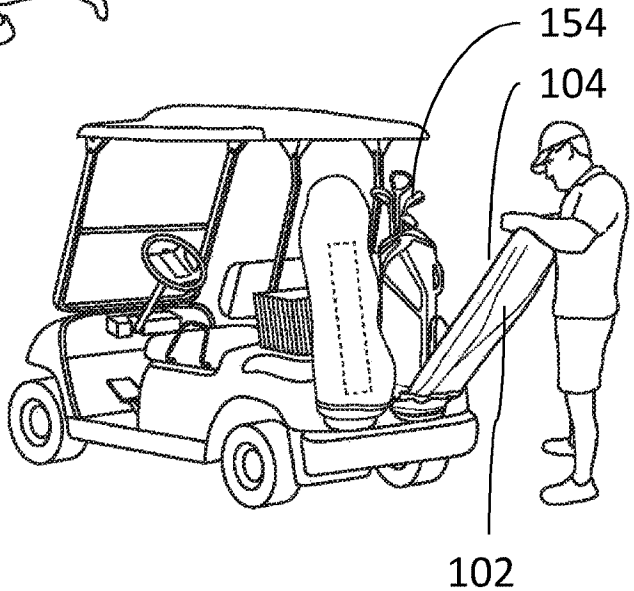
Figure 4A:
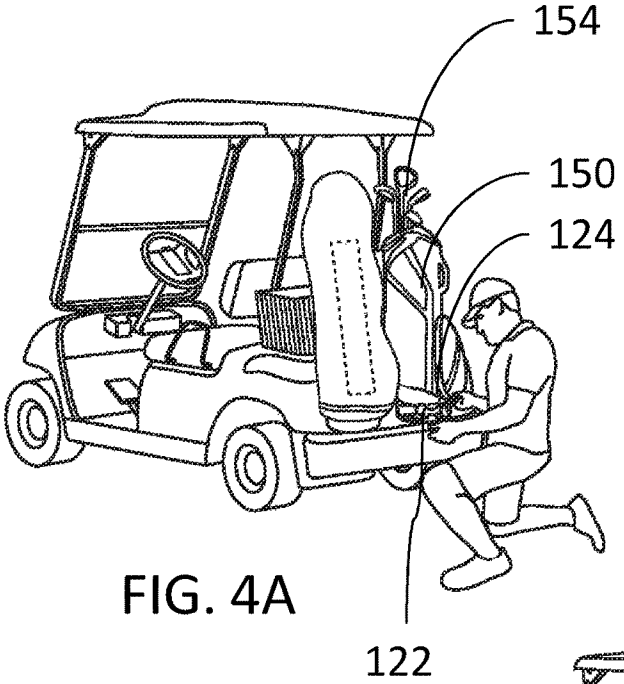

In the event of unwanted precipitation, golf bag cover 100 can be used to cover golf bag 150 and golf clubs 154 as depicted in FIGS. 4A-4C. When golf bag cover 100 is in the closed position, as depicted in FIG. 4A, pouch bottom coupling 124 can be decoupled from pouch top coupling 122 such that body 102 is no longer enclosed in pouch portion 106. Body 102 can then be pulled and stretched out via elastic edge 104, as depicted in FIG. 4B, such that body 102 is no longer in a collapsed position. Once body 102 is expanded, elastic edge 104 can be pulled over golf bag 150 and the golf clubs 154 such that top portion 114 covers golf clubs 154 as depicted in FIG. 4C. Elastic edge 114 can be manipulated around golf bag 150 to extend to the desired coverage such that golf bag 150 is also covered and golf bag cover 100 is in an open position covering both golf bag 150 and golf clubs 154. Elastic edge 114 causes cover 100 to fit tightly around the golf bag and clubs to also reduce the likelihood of sideways precipitation getting within the cover 100.

During play, a golfer can partially remove body 102 via elastic edge 104 from covering golf clubs 154 within golf bag 150 such that a golf club can be removed or replaced from golf bag 150. Because of the added structure of seams 120 and the elastic nature of elastic edge 104 and body 102, body 102 is biased to encapsulating golf bag 150 and golf clubs 154 within cavity 117. Thus, body 102 automatically returns to the open position wherein body 102 substantially covers golf bag 150 and golf clubs 154 once the user releases the body 102 after removing and/or replacing a club from the bag. As such, cover 100 does not need to be reattached to the golf bag.

When the precipitation subsides, golf bag cover 100 can return to the closed position in the reverse order depicted in FIGS. 4A-4C. Specifically, body 102 via elastic edge 104 can be pulled up and away from over golf clubs 154 such that body is in an open and stretched position as depicted in FIG. 4B. Body 102 can then be collapsed or rolled such that body 102 can be placed within pouch portion 106. Once body 102 is collapsed and placed within pouch portion 106, pouch bottom coupling 124 can be positioned over collapsed body 102 and coupled to pouch top coupling 122 such that body 102 is enclosed within pouch portion 106 as depicted in FIG. 4A.

Figure 5B:
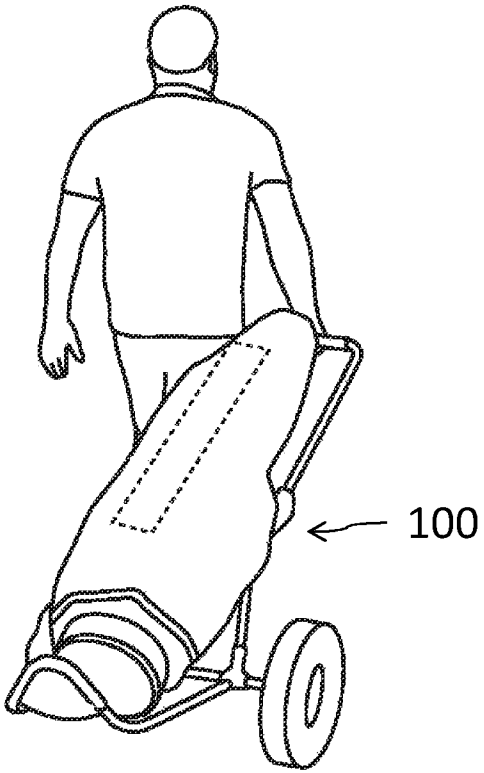
FIG. 5B is an isometric view of a golf bag cover covering a golf bag as the golf bag is coupled to a pull cart, according to embodiments disclosed herein.
Figure 5A:
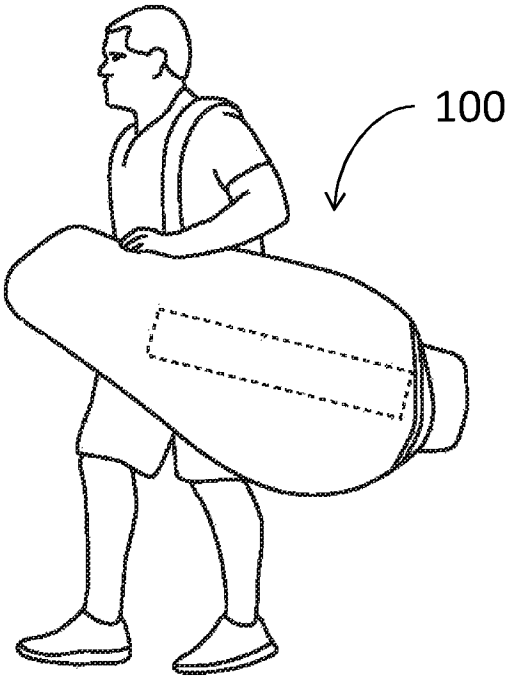
FIG. 5A is an isometric view of a golf bag cover covering a golf bag being carried by a golfer, according to embodiments disclosed herein.

As depicted in FIGS. 4A-4B, golf bag 150 and golf bag cover 100 are coupled to a golf cart. Further, golf bag cover 100 can be used in a similar fashion when golf bag 150 is in a stand-alone configuration and is carried by the golfer as depicted in FIG. 5A. Further, golf bag cover 100 can be used in a similar fashion when golf bag 150 is coupled to a pull cart as depicted in FIG. 5B. Golf bag cover 100 can be used in a similar fashion when golf bag 150 is coupled to a push cart or any other golf bag assisting mechanism.

Notably, golf bag cover 100 requires no lifting or decoupling of golf bag 150 from the golf cart for its use or installation. When in the closed position, golf bag cover 100 is compact and provides unencumbered access to golf bag 150 and the golf clubs.

Unlike other devices, the systems described herein do not require the entire golf bag to be placed inside the cover and simply unfurls from the bottom and secures over the top with elastic. By unfastening the cover that is secured at the bottom of the bag, golfers can quickly and easily keep golf bags and clubs dry in the event of precipitation. The system is fast, requiring no lifting of the bag or dismounting of the bag from the golf cart and also packs down very small, securing tightly to the bottom of the bag while providing more coverage to the club, bag and its contents.

Further, one method of making golf bag cover 100 includes marking pouch top coupling 122 position on base portion 112. Two seams 120 can be sewn into top portion of body 114. One of the two seams 120 can be arranged in a forward location, and one of the two seams 120 can be arranged in a rearward location of top portion of body 114. Seams 120 can be French seams, or other suitable seams. Sew and/or bind elastic edge 104 to the edge of body 102. In some embodiment, elastic edge 104 is only sewn into the vertical and top portions of body 102. One or more vertical seams 120 and/or pleats can be sewn into base portion 112 of body 102. In embodiments, one or more vertical seams 120 and/or pleats are sewn such that the folds that create the pleats are folded toward the center of body 102. Pouch top coupling 122 and/or loop portion of hook and loop coupling mechanism can be sewn to exterior surface 118 at the previously marked location on base portion 112. One or more pouch bottom couplings 124 and/or hook portions of hook and loop coupling mechanism can be sewn to a bottom edge of base portion 112. Bag coupling 108 and/or elastic strap can be sewn and/or top stitched to interior surface 118 at base portion 112. First portion 126 and second portion 128 of base coupling 108 can be overlapped at the center of body 102.

In another embodiment, golf bag cover can be unitarily formed with the golf bag rather than the cover attaching to the golf bag as a separate add on feature. For example, an opening may be made in the golf bag itself for storing cover. Body of cover can further be formed unitarily with golf bag to extend out of the opening and cover the golf bag as described herein. Body can then be inserted into opening and the opening closed when cover is not in use. Alternatively, opening may be formed in golf bag with body being a separate component that can be insertable into and removable from opening.

In an alternative embodiment, the bag coupling comprises a pair of straps. The straps further include a hook and loop coupling mechanism. In yet another embodiment, the straps further include a button snap coupling mechanism. In embodiments, the bag coupling is adjustable in length to fit around differently sized golf bags and/or different portions of golf backs and/or stands at the bottom of golf bags.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

For purposes of interpreting the claims, it is expressly intended that the provisions of 35 U.S.C. § 112(f) are not to be invoked unless the specific terms "means for" or "step for" are recited in a claim.

The invention claimed is:

1. A golf bag cover for use in covering a golf bag having golf clubs placed therein, the golf bag cover comprising:

a body including an edge and a bottom portion, the body defining a cavity sized and shaped to encapsulate a golf bag having golf clubs placed therein when in an open position;

an elastic edge coupled to the edge of the body;

a pouch portion coupled to the bottom portion of the body, the pouch portion being unitarily formed with the body such that the pouch portion and the base portion are monolithic, the pouch portion configured to be unfurled in an open position, a bottom edge of the pouch portion configured to fold upwards to form a pouch in a collapsed position, the body being collapsible such that the body can be housed within the pouch formed by the pouch portion when the body is in the collapsed position; and a bag coupling attached to the pouch portion, the bag coupling configured to attach to a bottom portion of the golf bag, wherein when the bag coupling is attached to the bottom portion of the golf bag, the body can be extended from the bottom portion of the golf bag to the open position to encapsulate a substantial portion of the golf clubs and the golf bag.

2. The golf bag cover of claim 1, wherein the body comprises a waterproof material.

3. The golf bag cover of claim 1, wherein the body comprises an elastic material.

4. The golf bag cover of claim 1, wherein the pouch portion includes a pouch bottom coupling and a pouch top coupling, the pouch bottom coupling being configured to couple to the pouch top coupling in the collapsed position such that the pouch formed by the pouch portion is secured.

5. The golf bag cover of claim 4, wherein the enclosure of the pouch portion is sized and shaped to house the body when the body is in a collapsed position.

6. The golf bag cover of claim 4, wherein the pouch bottom coupling and the pouch top coupling comprises a hook and loop coupling mechanism.

7. The golf bag cover of claim 1, wherein the bag coupling comprises a pair of straps, the straps further including a hook and loop coupling mechanism.

8. The golf bag cover of claim 1, wherein the elastic edge is biased to enclose the body around the golf bag and golf clubs.

9. The golf bag cover of claim 1, wherein the elastic edge is configured to return the body to an enclosing position such that the golf bag and golf clubs are enclosed within the cavity when the elastic edge and body are moved away from the golf bag and golf clubs.

10. The golf bag cover of claim 1, wherein the bag coupling is adjustable in length.

11. A golf bag cover system comprising:

a golf bag having a bottom portion and configured to have golf clubs placed therein; and a golf bag cover coupleable to the bottom portion of the golf bag, the golf bag cover including:

a body including an edge and a bottom portion, the body defining a cavity sized and shaped to encapsulate the golf bag and golf clubs in an open position, an elastic edge coupled to the edge of the body, the elastic edge running at least from the bottom portion of the golf bag to a top portion of the golf bag, the elastic edge being biased to encapsulate the golf clubs and the golf bag within the cavity of the body in the open position, a pouch portion coupled to the bottom portion of the body, the pouch portion configured to house the body when the body is in a collapsed position, and a bag coupling attached to the pouch portion, the bag coupling configured to attach to the bottom portion of the golf bag, and wherein when the bag coupling is attached to the bottom portion of the golf bag, the body can be extended from the bottom portion of the golf bag to the open position to encapsulate a substantial portion of the golf clubs and the golf bag.

12. The golf bag cover system claim 11, wherein the body comprises a waterproof material.

13. The golf bag cover system claim 11, wherein the body comprises an elastic material.

14. The golf bag cover system claim 11, wherein the pouch portion includes a pouch bottom coupling and a pouch top coupling, the pouch bottom coupling being configured to couple to the pouch top coupling such that the pouch portion defines an enclosure.

15. The golf bag cover system claim 14, wherein the enclosure of the pouch portion is sized and shaped to house the body when the body is in a collapsed position.

16. The golf bag cover system claim 14, wherein the pouch bottom coupling and the pouch top coupling comprises a hook and loop coupling mechanism.

17. The golf bag cover system claim 11, wherein the bag coupling comprises a pair of straps, the straps further including a hook and loop coupling mechanism.

18. The golf bag cover system of claim 11, wherein the elastic edge is biased to enclose the body around the golf bag and golf clubs.

19. The golf bag cover system of claim 11, wherein the elastic edge is configured to return the body to an enclosing position such that the golf bag and golf clubs are enclosed within the cavity when the elastic edge and body are moved away from the golf bag and golf clubs.

20. The golf bag cover system claim 11, wherein the bag coupling is adjustable in length.

* * * * *